United States Patent [19]

Mueller

[11] Patent Number: 4,964,822

[45] Date of Patent: Oct. 23, 1990

[54] VARIABLE PITCH PROPELLER FOR WATERCRAFT

[76] Inventor: Peter Mueller, Widmerstrasse 27, Zurich, Switzerland

[21] Appl. No.: 295,830

[22] Filed: Jan. 11, 1989

Related U.S. Application Data

[63] Continuation-in-part of Ser. No. 21,653, Mar. 14, 1987, abandoned, which is a continuation-in-part of Ser. No. 711,161, Mar. 13, 1985, Pat. No. 4,648,847.

[51] Int. Cl.[5] ..... B63H 3/08

[52] U.S. Cl. ..... 440/50; 416/166; 416/162

[58] Field of Search ..... 440/50, 51, 83, 49; 419/159–168 R

[56] References Cited

U.S. PATENT DOCUMENTS 2,704,991 3/1955 Danielson ..... 440/50
4,599,043 7/1986 Mueller ..... 416/164

FOREIGN PATENT DOCUMENTS 4789 of 1905 United Kingdom ..... 416/166
21067 of 1911 United Kingdom ..... 416/164

*Primary Examiner*—Joseph F. Peters, Jr.

*Assistant Examiner*—Edwin L. Swinehart

*Attorney, Agent, or Firm*—Helfgott & Karas

[57] ABSTRACT

A watercraft has a hull and a hollow support body secured below the hull. A propeller drive shaft is disposed rotatably in the body with one end extending out of the body and is adapted for connection to a driving engine. A main bearing for the drive shaft is disposed in the body, the shaft extending through the bearing. A variable pitch propeller has a hub and a plurality of variable pitch propeller blades. The hub is secured to the shaft. A plurality of adjusting elements are mounted in the hub parallel to the shaft, each element being secured to a corresponding blade for varying the pitch thereof. A coupling is slidably disposed along the shaft in the support body with a rotatable first section secured to the hub and a non-rotatable first section spaced from the shaft and having bearing means in which the first section is rotatably supported. The adjusting elements are secured to the first section whereby movement of the second section back and forth along the shaft appropriately adjusts the pitch of the blades. An adjusting rod linkage is disposed in the body and is secured to the second section for moving the second section.

11 Claims, 3 Drawing Sheets

VARIABLE PITCH PROPELLER FOR WATERCRAFT

CROSS REFERENCE TO RELATED APPLICATIONS

This application is a continuation-in-part of copending application Ser. No. 021,653 filed Mar. 4, 1987, now abandoned which is a continuation-in-part of application Ser. No. 711,161 filed Mar. 13, 1985 and now U.S. Pat. No. 4,648,847.

BACKGROUND OF THE INVENTION

The present invention relates to a variable pitch propeller for a watercraft, in which the main shaft of the motor located in the hull of the watercraft is coupled directly or via a gear to the propeller drive shaft, which extends through the hull wall, said propeller shaft is supported by a bearing located in a hollow brace strut, outside the hull. The brace strut is fixed to the hull wall and is located nearby the variable pitch propeller, the latter being equipped with adjustable blades mounted in the propeller hub. A connecting rod linkage is provided for adjusting the propeller blades, whose connecting rods are displaceable by means of a rotary slide coupling through an adjusting linkage, actuated by a linear motor (electric or hydraulic) and controlled manually or electronically.

Various constructions of variable pitch propellers and their adjustment means enabling the pitch of the propeller blades to be adjusted are known. They serve, on the one hand, to better utilize the installed power of the motor in a watercraft and, on the other, to facilitate the handling of said watercraft. The pitch of the propeller blades can be adapted manually or automatically to the particular use, it being possible to adjust the propeller blades for reverse thrust.

Whereas the variable pitch propeller is driven by a propeller shaft driven by a motor drive in the interior of the watercraft, the adjustment of the propeller blades is brought about in different ways. Thus it is known to introduce a pressure medium into the propeller hub and thereby act on a piston system arranged in the hub enabling the propeller blades to be adjusted (U.S. Pat. No. 2,931,443).

It is also known to adjust the propeller blades by means of a mechanical linkage or gear, the adjusting force being applied manually. The adjusting movement is transferred by means of a rotary slide coupling mounted in the propeller hub to connecting rods enabling the individual propeller blades to be adjusted (U.S. Pat. No. 2,742,097). The rotary slide coupling comprises a non-rotary part and a rotary part, between which are installed radial and axial bearings, which, on the one hand, permit the relative movement of the two parts and, on the other, transfer the adjusting force from the non-rotary to the rotary part.

Two constructional embodiments are known for the arrangement of the variable pitch propeller on the watercraft. In the first construction, known as the stern drive, the hub is incorporated into part of the rudder body and is driven by means of two mitre gears, through which a Z-shaped arrangement of the shaft from the drive motor to the adjusting hub is obtained.

In another construction, the motor shaft is coupled directly or via a gear to the propeller shaft, which extends outwards through the watercraft hull and carries at its end the variable pitch propeller. The main bearing is supported on the watercraft hull by means of a support body, which is also called a propeller bracket or brace strut.

SUMMARY OF THE INVENTION

The present invention relates to a propeller drive of the second type and one of the objects of the invention is to further develop a variable pitch propeller of the aforementioned type so that a simple, less expensive, streamlined arrangement for the support body and adjusting linkage is obtained. The invention aims to replace the common brace struts in boats and ships, using the standard propeller shaft and propeller locking.

According to the invention this and other objects are attained by that the support body receiving the propeller shaft bearing and supported on the watercraft hull is constructed as a single strut which also serves as the carrier means for the adjusting linkage.

Appropriately the support body is hollow and has access to the interior of the hull and in the inner area thereof is housed the adjusting linkage for adjusting the propeller blades.

More particularly, in accordance with the invention, a watercraft has a hull and a single hollow support body secured below the hull and accommodating that propeller and all adjusting means therefor. A propeller drive shaft is disposed rotatably in the support body with one end extending out of the support body and is adapted for connection to a driving engine. A main bearing for the shaft is disposed in the support body, the propeller shaft extending through the bearing. A bracket is disposed in the body which is secured both to the body and the bearing to support the bearing within the body. A variable pitch propeller has a hub and a plurality of variable pitch propeller blades. The hub is disposed nearby the support body and is secured to the propeller shaft. A like plurality of adjustable elements are mounted in the hub parallel to the shaft, each element being secured to a corresponding blade for varying the pitch thereof. A coupling is slidably mounted along the shaft in the body with a first rotatable section secured to the hub and a second non-rotatable section spaced from the propeller shaft and having bearing means in which the first section is rotatably supported. The elements are secured to the first section whereby the axial movement of the second section along the shaft appropriately adjusts the pitch of the blades. An adjusting rod linkage is disposed in the support body and is secured to the second section of the coupling for moving the second section. An actuation device is disposed in the watercraft remote from the support body and is secured to the linkage for remotely operating the linkage to adjust the pitch of the blades.

The variable pitch propeller may have passages which can be used as a flue gas outlet for the watercraft. A tube is used to introduce the flue gases from the motor into the support body which encloses the variable pitch propeller as well all adjusting means for adjusting the pitch of its blades.

The aforementioned objects and advantages of the invention as well as other objects and advantages thereof will either be explained or will become apparent to those skilled in the art when this specification is read in conjunction with the accompanying drawings and specific description of the preferred embodiments which follow.

DETAILED DESCRIPTION OF THE PREFERRED EMBODIMENTS

Figure 1:
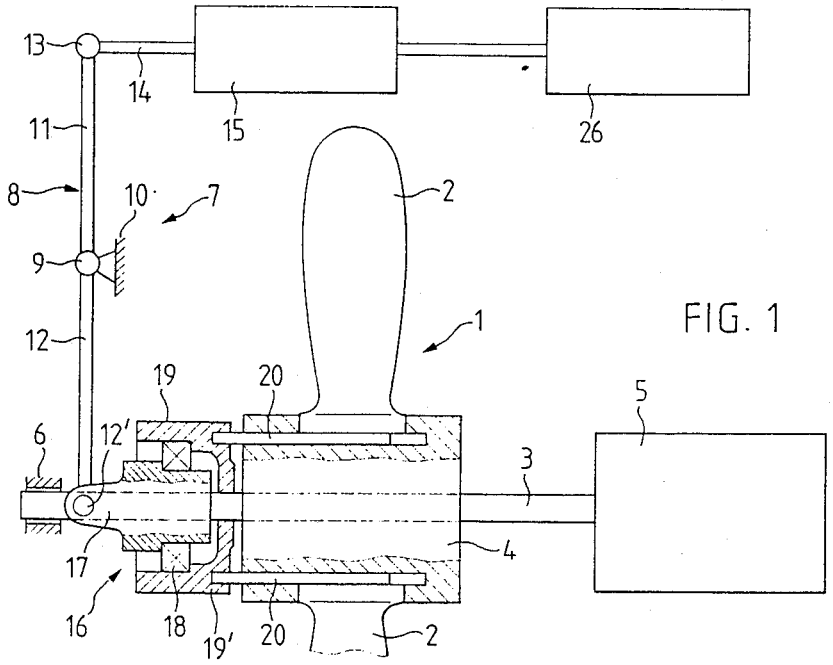
FIG. 1 is a diagrammatic representation of the arrangement of a variable pitch propeller with its adjusting means, the latter being located on the outflow side of the propeller.

In the diagrammatically represented watercraft drive of FIG. 1, 1 is a variable pitch propeller, which has adjustable propeller blades 2 and a propeller hub 4 driven by a drive shaft 3. Drive shaft 3 is driven by a driving engine 5 and is mounted in a main bearing 6 located on the outflow side of the propeller, but in the vicinity thereof.

The adjustment of the pitch of propeller blades 2 takes place by means of an adjusting linkage 7, which has a two-armed adjusting lever 8, whose pivot pin 9 is pivotally supported in a step bearing 10. Step bearing 10 is supported on the watercraft hull. Adjusting lever 8 has an upper arm 11 and a lower arm 12, upper arm 11 being coupled by means of a joint 13 to a push rod 14 of a linear motor 15 driven by a power source 26, while the lower arm 12 is connected by means of a joint 12, to a rotary slide coupling 16. The latter has a non-rotary coupling part or section 17, which is connected by means of joint 12, to the lower arm 12, while the rotary coupling part or section 19 is fixed to drive shaft 3 and guides the non-rotary part 17 by means of radial and axial bearings (only bearing 18 is diagrammatically shown). On flange 19' of the rotary coupling part 19 are supported connecting rods 20, which are guided in the propeller hub 4 and simultaneously adjust the individual propeller blades 2 in the manner described in U.S. Pat. No. 4,599,043, the disclosure of which is incorporated herein by reference. As in U.S. Pat. No. 4,599,043, adjusting pins (not shown) are provided between the connecting rods 20 and the propeller hub to turn the same and adjust the blades connected thereto. The rotary slide coupling 16 and connecting rods 20 form the connecting linkage between the propeller's blades and the adjusting linkage 7.

Figure 2:
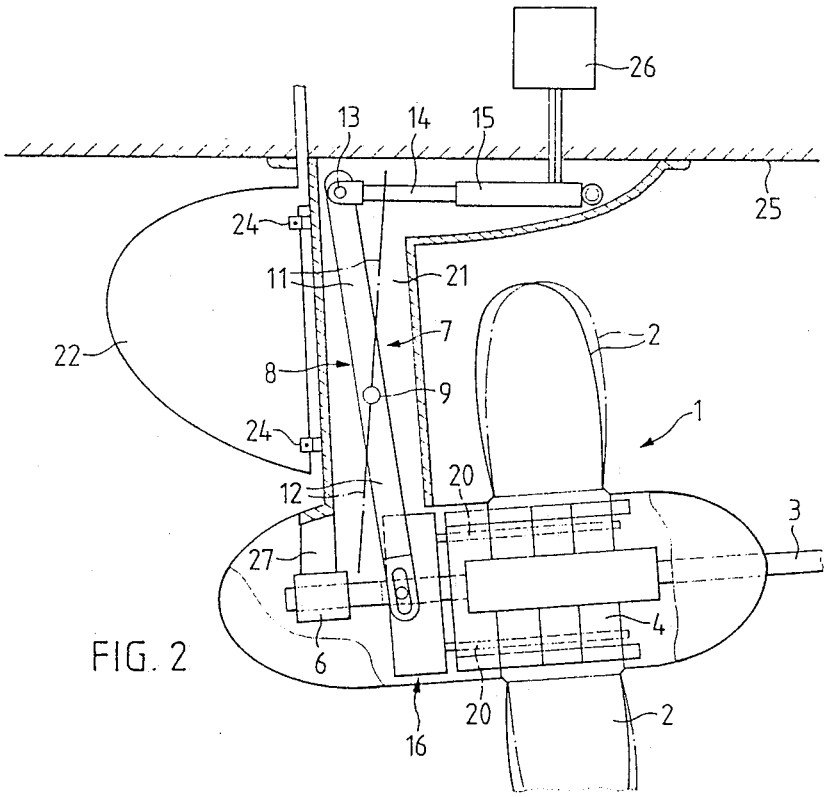
FIG. 2 shows a first embodiment of a variable pitch propeller fixed to a watercraft hull according to the arrangement of FIG. 1, partly in section.

In FIG. 2 the variable pitch propeller 1 is arranged in fixed manner below a hull 25 of a watercraft. A hollow support body 21 formed as a single hollow angle-shaped or L-shaped element is fixed to the hull 25. A substantially vertical arm or portion 50 of the hollow support body accommodates the adjusting linkage 7 with push rod 14 while its substantially horizontal arm or portion 60 accommodates the variable propeller pitch 1 with its blades extending outwardly. Horizontal arm or portion 60 is of streamlined shape. In the support body 21 is provided the aforementioned main bearing 6 for mounting the propeller shaft 3. Bearing 6 is fixed by means of a support or bracket 27 to support body 21. On the outflow side of support body 21 is pivotably mounted a rudder 22 by means of hinges 24, while the adjusting linkage 7 is installed within arm 50 of the support body 21. The references not referred to in FIG. 2 coincide with those of FIG. 1. Linear motor 15 is e.g. a double acting hydraulic cylinder, whose piston rod forms push rod 14 and by means of joint 13 is connected to the upper arm 11 of lever 8. Linear motor 15, which can also be an electric or hydraulic unit, is mounted in the construction according to FIG. 2 below hull 25 in the hollow support body 21 which has an outwardly extending portion 62. It would also be possible to construct the upper arm 11 of the adjusting lever in such a way that it would be projected into the watercraft and linear motor 15 would then be located within hull 25. Due to the fact that the adjusting linkage 7 is used for transferring the adjusting forces to the connecting linkage 16, 20, while linear motor 15 at a distance therefrom produces the energy required for overcoming the adjusting forces, a cost and space-saving solution adaptable to random space conditions is obtained.

Figure 3:
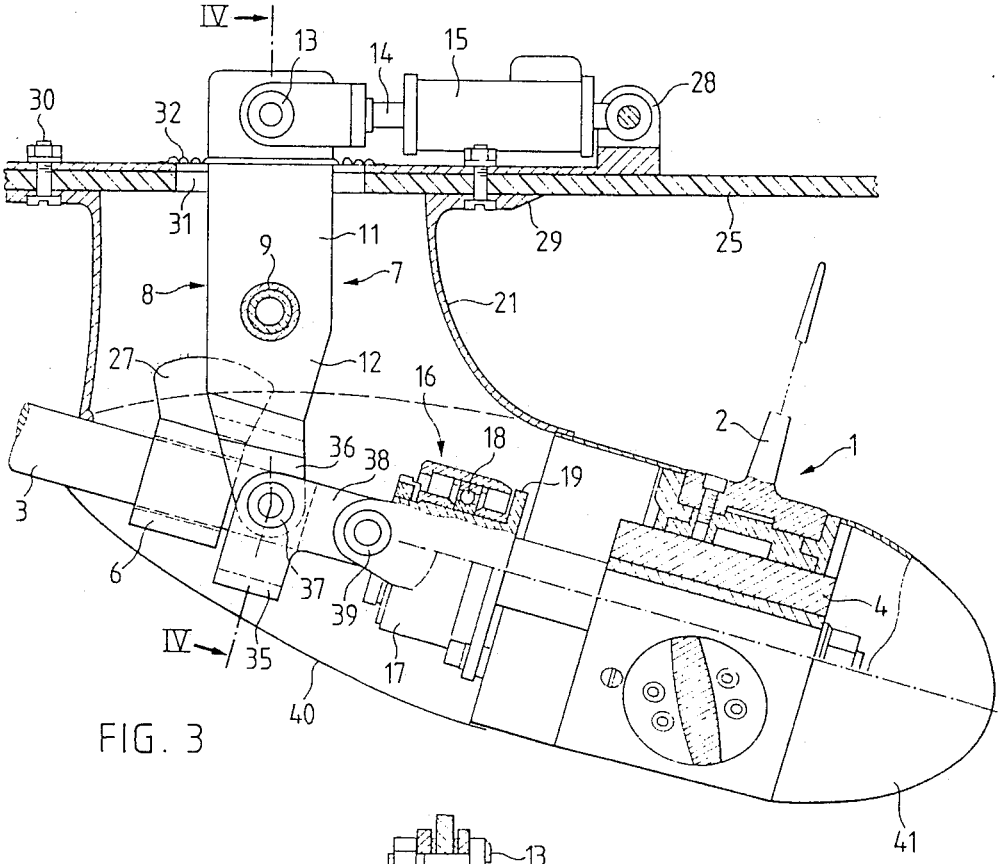
FIG. 3 shows a second embodiment of a variable pitch propeller fixed to a watercraft hull, partly in section, but with the main bearing located on the inflow side of the propeller.

FIG. 3 shows a similar fixing of the variable pitch propeller 1 to that of FIG. 2, but with the difference that the main bearing 6 is positioned on the inflow side of propeller 1. However, in the same way as in the construction according to FIG. 2, it is fixed by a bracket or support 27*a* to the inner wall of support body 21. In the same way pivot pin 9 of adjusting lever 8 is supported on the wall of the hollow support body 21. Linear motor 15 is fixed by means of a pedestal bearing 28 within the hull 25.

Support body 21 has a flange 29 by means of which it is fixed by screws 30 to hull 25. There is a narrow opening 31 in hull 25, through which extends the end of the upper arm 11 of adjusting lever 8. In addition, opening 31 is protected by a seal 32, e.g. a siphon gland against the entry of water.

The lower arm 12 of adjusting lever 8 is provided at its free end with a yoke 36, which engages over the propeller shaft 3. At the ends of yoke 36 are provided joints 37, in which is mounted a stirrup 35 with cover plates 38. The latter are connected by means of joints 39 to the displaceable, non-rotary part 17 of the rotary slide coupling 16, while the rotary part 19 is connected to the connecting rods 20. Reference is made to the aforementioned continuation-in-part application Ser. No. 021,653 and to U.S. Pat. No. 4,599,043 regarding details of the connecting linkage 16,20.

Figure 4:
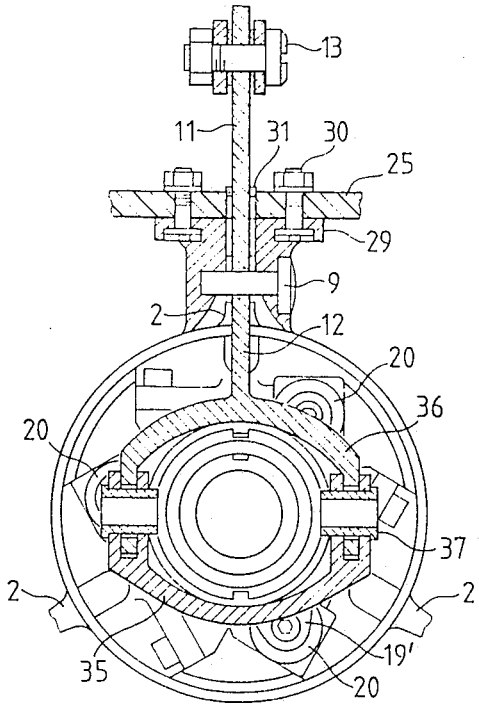
FIG. 4 is a cross sectional view taken along line IV—IV of FIG. 3.

FIG. 4 shows that there are three connecting rods 20, which are fixed to flange 19, of rotary part 19. Reference is also made to the above patent in connection with the mounting of propeller blades 2. Support body 21 has at the lower part thereof a cover portion 40 provided in the vicinity of main bearing 6, while the propeller hub is covered by a dome-shaped portion 41 of the support body 21. Portion 41 may be connected to portion 40 by any suitable conventional means and forms with portion 40 a streamlined horizontal arm of support body 21.

Figure 5:
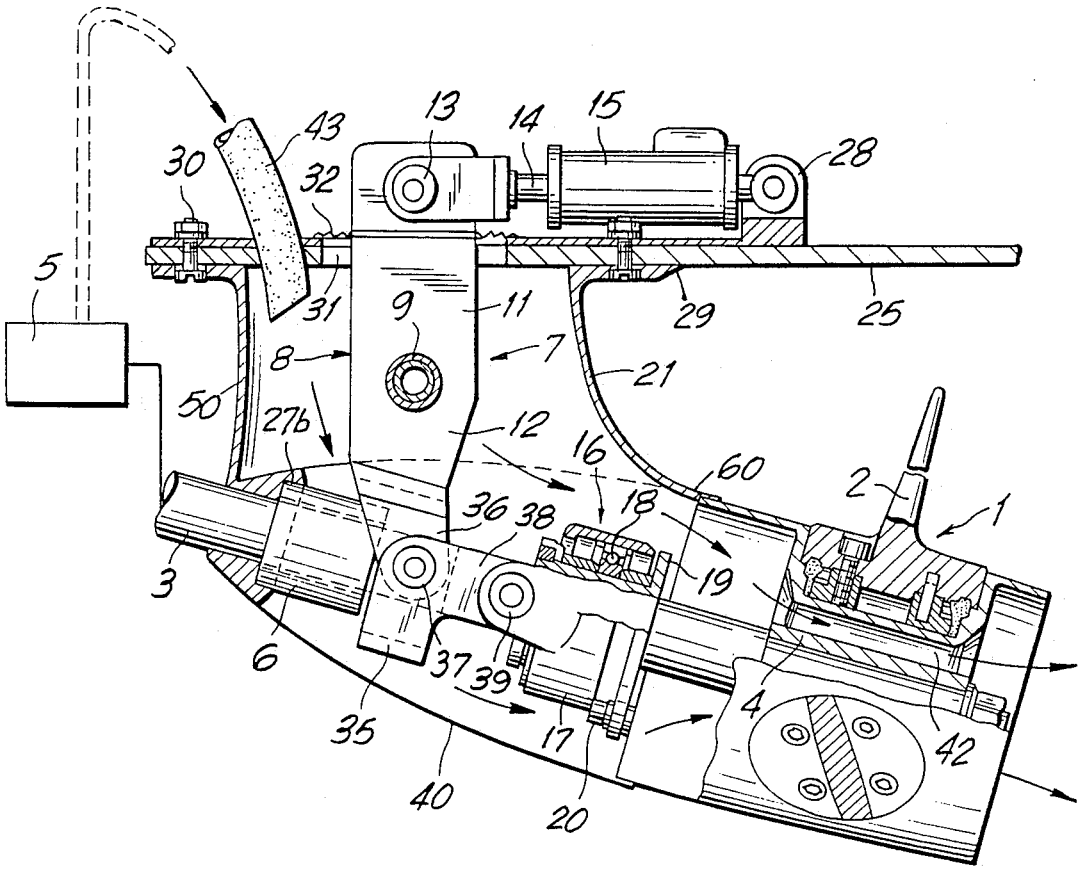
FIG. 5 illustrates a variable pitch propeller, partly in section, provided with a tube for introducing flue gases from the motor into the propeller and passages for discharging flue gases from the latter.

Referring now to FIG. 5 it will be seen that a tube 43 is provided, the end of which is inserted through the wall of hull 25 into support body 21, and which conveys flue gases from the engine into the variable pitch propeller 1. The end of tube 43 inserted into the support body 21, more particularly its vertical arm, is sealed by a seal similar to seal 32. Hub 4 is formed with passages 42 which can be spaced circumferentially from each other and form flue gas outlets. The path of flue gases within the support body 21 and hub 4 of propeller 1 is shown by arrows. Reference numeral 27b denotes a wall portion of the support body for connecting the same to main bearing 6. The remaining elements of the arrangement shown in FIG. 5 are similar to those of FIG. 3.

The described variable pitch propeller is characterized by its space saving nature. The arrangement of the adjusting linkage 7 for the adjustment of the propeller blades 2 makes it possible to choose a narrow and therefore streamlined shape of the support body 21, so that the total resistance of such construction is scarcely greater than for a propeller with fixed blades. Support body 21 hereby exercises a double function. It, on the one hand, forms the propeller portion for supporting the main bearing 6 on hull 25 and, on the other hand, receives and supports the adjusting linkage 7.

While the fundamental novel features of the invention have been shown and described and pointed out, it will be understood that various substitutions and changes in the form of the details of the embodiments shown may be made by those skilled in the art without departing from the scope of the claims which follow.

What is claimed is:

1. A watercraft, comprising:

a hull;

a single hollow support body secured below the hull;

a variable pitch propeller having a hub and a plurality of variable pitch propeller blades secured to said hub;

a propeller drive shaft disposed rotatably in said hollow support body with one end extending out of the body and adapted for connection to a driving engine;

a bearing provided at an inflow side of said propeller for said propeller shaft, said bearing being secured to said hollow support body, the shaft extending through the bearing;

adjustable elements mounted in the hub for varying the pitch of said blades;

said hub being connected to said drive shaft;

a coupling slidably disposed along the shaft in said hollow support body, said coupling having a rotatable first section secured to the propeller hub and a non-rotatable second section spaced from the shaft and having bearing means in which said first section is rotatably supported, the adjustable elements being secured to the first section, wherein movement of the second section back and forth along the shaft adjusts the pitch of the blades;

an adjusting rod linkage having an upper arm and a lower arm connected to said upper arm and secured to the second section for moving the second section;

remote means disposed in the water-craft remote from said hollow support body and being operatively connected to the adjusting rod linkage;

said single hollow support body being substantially L-shaped and having an arm connected to the hull and situated at the inflow side of said propeller, said support body accommodating and supporting said adjusting rod linkage, said bearing, said coupling, said adjusting elements and said hub;

and means for connecting said lower arm to the second section, said connecting means including a yoke provided at an end of said lower arm and a stirrup connected to said yoke by joints, said stirrup having cover plates connected to said second section by further joints.

2. The wavercraft of claim 1, wherein said upper and lower arms are pivotally connected at a pivot point positioned intermediate thereof to a pivot pin supported in the support body, said upper arm of the adjusting rod linkage being secured to the remote means.

3. The watercraft of claim 1, wherein said coupling is disposed between said hub and said bearing.

4. The watercraft of claim 1, and further including tube means for conveying flue gases from said driving engine into said support body.

5. The watercraft of claim 4, wherein said hub has outlet passages for flue gases passed through said support body.

6. The watercraft of claim 2, wherein said pivot pin is supported in an inner wall of said support body.

7. The watercraft of claim 2, wherein said upper arm extends at one end thereof into said hull.

8. The watercraft of claim 7, wherein a seal is provided at an extension of said upper arm into said hull.

9. The watercraft of claim 2, wherein said upper arm has a portion laterally outwardly projecting therefrom and accommodating at least partially said remote means.

10. The watercraft of claim 2, wherein said remote means includes a push rod coupled by a joint to said upper arm, a linear motor connected to said push rod, and a power source for actuating said linear motor.

11. The watercraft of claim 1, wherein said yoke and said stirrup are connected to form a ring.

* * * * *